US012201202B2

(12) United States Patent
Nicolaou et al.

(10) Patent No.: US 12,201,202 B2
(45) Date of Patent: Jan. 21, 2025

(54) HAIR STYLING APPLIANCE

(71) Applicant: Dyson Technology Limited, Wiltshire (GB)

(72) Inventors: Richard David Nicolaou, Bristol (GB); Frederick Stuart Grotrian, Swindon (GB); George Normile Elliot Baxter, Singapore (SG); Nathan Haruna Waters Imhasly, Bath (GB); Rory William Beaumont, Bristol (GB); Stephen Benjamin Courtney, Gloucester (GB); Maurizio Ballarati, Swindon (GB); Alexander Edward Hughes, Swindon (GB); Robert Mark Brett Coulton, Bristol (GB)

(73) Assignee: Dyson Technology Limited, Wiltshire (GB)

( * ) Notice: Subject to any disclaimer, the term of this patent is extended or adjusted under 35 U.S.C. 154(b) by 657 days.

(21) Appl. No.: 17/420,311

(22) PCT Filed: Nov. 20, 2019

(86) PCT No.: PCT/GB2019/053283
§ 371 (c)(1),
(2) Date: Jul. 1, 2021

(87) PCT Pub. No.: WO2020/141295
PCT Pub. Date: Jul. 9, 2020

(65) Prior Publication Data

US 2022/0087391 A1 Mar. 24, 2022

(30) Foreign Application Priority Data

Jan. 2, 2019 (GB) ..... 1900012
Jan. 2, 2019 (GB) ..... 1900013
Jan. 2, 2019 (GB) ..... 1900014

(51) Int. Cl.
*A45D 2/00* (2006.01)

(52) U.S. Cl.
CPC ..... *A45D 2/001* (2013.01)

(58) Field of Classification Search
CPC ..... A45D 2/001; A45D 2/40
See application file for complete search history.

(56) References Cited

U.S. PATENT DOCUMENTS 6,191,387 B1 * 2/2001 Smal ..... A45D 2/001 132/224
2007/0174984 A1 * 8/2007 Diamond ..... A46B 5/0012 15/160

(Continued)

FOREIGN PATENT DOCUMENTS

CN 1248148 A 3/2000
CN 1921782 A 2/2007

(Continued)

OTHER PUBLICATIONS

Machine Translation of Tsuji; Available May 1999.*

(Continued)

*Primary Examiner* — Rachel R Steitz
*Assistant Examiner* — Brianne E Kalach
(74) *Attorney, Agent, or Firm* — Tucker Ellis LLP

(57) ABSTRACT

The present invention relates to a hair straightening apparatus having two arms pivotably coupled together and a heating plate on a facing side of at least one arm. A central pack disposed between the first arm and the second arm and coupled to the hair styling apparatus at the hinge end and a biasing means adapted to support the central pack symmetrically between the first arm and the second arm.

20 Claims, 11 Drawing Sheets

(56) References Cited

U.S. PATENT DOCUMENTS

| | | | | |
|---|---|---|---|---|
| 2008/0223394 | A1 | 9/2008 | Maddocks et al. | |
| 2009/0301509 | A1 | 12/2009 | Leung | |
| 2010/0170883 | A1 | 7/2010 | Legrain et al. | |
| 2011/0305942 | A1 | 12/2011 | Park | |
| 2012/0138081 | A1 | 6/2012 | Lee | |
| 2013/0098389 | A1* | 4/2013 | Uwano | A45D 1/04 29/860 |
| 2015/0216280 | A1 | 8/2015 | Sayers et al. | |
| 2015/0289622 | A1 | 10/2015 | Fereyre et al. | |
| 2016/0255936 | A1 | 9/2016 | deGrood | |

FOREIGN PATENT DOCUMENTS

| | | | | | |
|---|---|---|---|---|---|
| CN | 201108132 | Y | | 9/2008 | |
| CN | 101677662 | A | | 3/2010 | |
| CN | 201422539 | Y | | 3/2010 | |
| CN | 104582524 | A | | 4/2015 | |
| CN | 204273546 | U | | 4/2015 | |
| CN | 104883925 | A | | 9/2015 | |
| CN | 105877096 | A | | 8/2016 | |
| CN | 107427116 | A | | 12/2017 | |
| CN | 207653756 | U | | 7/2018 | |
| CN | 207927981 | U | | 10/2018 | |
| CN | 212185556 | U | | 12/2020 | |
| EP | 3187067 | A1 | | 7/2017 | |
| EP | 3367462 | A1 | | 8/2018 | |
| FR | 2997271 | | * | 10/2012 | |
| GB | 2420277 | A | * | 5/2006 | A45D 1/04 |
| GB | 2456233 | | * | 7/2009 | |
| JP | 2889305 | | * | 5/1999 | |
| JP | 2002-51825 | A | | 2/2002 | |
| JP | 2002051825 | A | * | 2/2002 | |
| JP | 2013-121497 | A | | 6/2013 | |
| JP | 2018-166896 | A | | 11/2018 | |
| KR | 10-0539710 | B1 | | 12/2005 | |
| KR | 10-0548878 | B1 | | 2/2006 | |
| KR | 10-0634888 | B1 | | 10/2006 | |
| KR | 10-0684145 | B1 | | 2/2007 | |
| KR | 20-0439388 | Y1 | | 4/2008 | |
| KR | 978039 | B1 | * | 8/2010 | A45D 1/04 |
| WO | 98/35578 | A1 | | 8/1998 | |
| WO | 2005/082198 | A1 | | 9/2005 | |
| WO | 2007/078048 | A1 | | 7/2007 | |
| WO | 2011/021783 | A2 | | 2/2011 | |
| WO | 2015/190939 | A1 | | 12/2015 | |
| WO | 2020/141294 | A1 | | 7/2020 | |

OTHER PUBLICATIONS

Machine Translation of Fereyre; Available Oct. 2012.*

International Search Report and Written Opinion received for PCT Patent Application No. PCT/GB2019/053282, mailed on Feb. 19, 2020, 13 pages.

Office Action received for Chinese Patent Application No. 201980086547.9, mailed on Oct. 21, 2023, 18 pages (11 pages of English Translation and 7 pages of Original Document).

Office Action received for Chinese Patent Application No. 201911356305.5, mailed on Jul. 22, 2022, 16 pages (8 pages of English Translation and 8 pages of Original Document).

Evaluation Report dated Feb. 24, 2021, directed to CN Application No. CZL2019223746823; 6 pages.

International Search Report and Written Opinion dated Jan. 30, 2020, directed to International Application No. PCT/GB2019/053283; 13 pages.

Search Report dated Jun. 17, 2019, directed to GB Application No. 1900013.2; 1 page.

Search Report dated Jun. 18, 2019, directed to GB Application No. 1900012.4; 1 page.

Search Report dated Jun. 18, 2019, directed to GB Application No. 1900014.0; 2 pages.

Office Action received for Korean Patent Application No. 10-2021-7023677, mailed on Nov. 25, 2022, 10 pages (5 pages of English Translation and 5 pages of Original Document).

* cited by examiner

HAIR STYLING APPLIANCE

REFERENCE TO RELATED APPLICATIONS

This application is a national phase application under 35 USC 371 of International Application No. PCT/GB2019/053283, filed Nov. 20, 2019, which claims the priority of United Kingdom Application No. 190012.4, filed Jan. 2, 2019, United Kingdom Application No. 190013.2, filed Jan. 2, 2019, and United Kingdom Application No. 190014.0, filed Jan. 2, 2019, the entire contents of each of which are incorporated herein by reference.

FIELD OF THE DISCLOSURE

The present invention relates to a hair styling appliance. Heated hair styling appliances are designed to use the action of heat and mechanical means or airflow to form hair into a desired shape or style.

BACKGROUND OF THE DISCLOSURE

A hair straightener utilises heated plates attached to pivoted arms which can be held, by a user, in a closed position with a tress of hair clamped between the heated plates. The tress of hair can be styled into a changed shape once the hair is heated above a transition temperature.

Both corded and cordless hair styling appliances are known, including cordless hair straighteners having a battery pack which can be recharged by the user. A typical cordless hair straightener may have a battery pack disposed in one arm, thereby creating an imbalance in the weight distribution of the hair straightener. Styling hair with hair straighteners requires a repetitive user action, and an imbalance in the weight distribution of the appliance can lead to discomfort in the hand of the user. It is therefore desirable to provide an improved hair styling apparatus.

SUMMARY OF THE DISCLOSURE

A first aspect of the present invention provides a hair styling apparatus comprising a first arm and a second arm coupled together at a hinge end thereof to allow the first arm and the second arm to be moveable between a closed position, in which a facing side of the first arm and a facing side of the second arm are adjacent, and an open position, in which the facing side of the first arm and the facing side of the second arm are spaced apart, a central pack disposed between the first arm and the second arm and coupled to the hair styling apparatus at the hinge end; and a biasing means adapted to support the central pack symmetrically between the first arm and the second arm.

Such a symmetrical, balanced arrangement improves the ergonomics of the hair styling apparatus.

In use, an air gap is formed between the first arm and the central pack and also between the second arm and the central pack. Advantageously, each air gap forms thermal insulation between the arms and the central pack, thereby minimizing heat transfer between the user's hands, the central pack and heating means in the arms.

Preferably, the central pack is a power pack, and the power pack comprises at least one cell.

In a preferred embodiment, the central pack comprises a motor and a fan.

The hair styling apparatus may further comprise a cover connected between the first arm and the second arm, wherein the cover is adapted to protect the central pack.

Preferably, the biasing means comprises at least one spring. The at least one spring preferably comprises a first spring coupled between the first arm and the central pack, and a second spring coupled between the second arm and the central pack, wherein the first spring and the second spring are symmetrically disposed with respect to a longitudinal central axis of the hair styling apparatus. Further, the first spring and the second spring may be coil springs or leaf springs, and may be integrally formed from a metal arm casing structure.

In a preferred embodiment, the at least one spring comprises a torsion spring coupled to a coil spring, wherein the torsion spring may comprise a pivot and a first leg and a second leg attached to the first arm and the second arm, respectively. Further, the coil spring comprises a first end attached to the pivot via a lug, and a second end attached to the central pack.

A simple coil spring has a spring force which increases as the spring is progressively compressed. Advantageously, this arrangement of the torsion spring and the coil spring provides a progressively lower spring force as the styling apparatus arms are moved into the closed position, whilst providing a greater spring force when the styling apparatus arms are open.

Preferably, the hair styling apparatus comprises a cover connected between the first arm and the second arm, wherein the cover is adapted to protect the central pack. More preferably, the cover is attached to the torsion spring, thereby enabling the cover to retract when the first arm and the second arm are in the closed position.

In a preferred embodiment the first arm and the second arm are symmetrical in structure, and are substantially identical in weight, and further the central pack is substantially symmetrical in structure about the longitudinal central axis of the hair styling apparatus.

A second aspect of the present invention provides a hair styling apparatus comprising a first arm and a second arm coupled together at a hinge end thereof to allow the first arm and the second arm to be moveable between a closed position, in which a facing side of the first arm and a facing side of the second arm are adjacent, and an open position, in which the facing side of the first arm and the facing side of the second arm are spaced apart, a power pack disposed between the first arm and the second arm and coupled to the hair styling apparatus at the hinge end, wherein the power pack comprises a plurality of cells.

Preferably, the battery pack comprises four cells, wherein the four cells are interconnected and comprise four cells connected in series, or two cells connected in parallel and two cells connected in series.

In a preferred embodiment, each cell is a secondary cell. Each cell may be an elongate lithium-ion cell, having an electrical contact at each end. Preferably, each electrical contact is connected to a battery tab. Preferably, the battery tab comprises a yield line.

In a preferred embodiment, the battery tab connects two adjacent electrical contacts and has a folded arrangement, such that the battery tab is folded through 180 degrees. Further, the battery tab may have a yield line and a slot extending from an edge of the battery tab such that the slot traverses the yield line and divides in two parts at that junction, thereby forming a Y-shaped slot.

It is preferred that each electrical contact is connected to a battery tab by resistance welding. Preferably, the power pack comprises a sleeve adapted to receive a frame, such that the frame supports the four cells. Advantageously, the sleeve minimizes ingress of debris in proximity to the cells and the associated interconnections. Also, the sleeve may function to protect the cells, interconnections and PCBs if the hair styling apparatus were to suffer an impact. Further, the sleeve provides structural rigidity to the hair styling apparatus.

A third aspect of the present invention provides a battery tab for connection to a cell contact, the battery tab comprising a slot, wherein a first portion of the slot extends in a straight line from an edge of the battery tab, and then divides in two parts, thereby forming a Y-shaped slot. Advantageously, such a Y-shaped slot avoids a major part of the slot being coterminous with a battery tab yield line.

Preferably, the first portion extends midway between a first pair of projections and a second pair of projections. The projections may be welded to the cell terminal by resistance welding.

A fourth aspect of the present invention provides a hair styling apparatus comprising a first arm and a second arm coupled together at a hinge end thereof to allow the first arm and the second arm to be moveable between a closed position, in which a facing side of the first arm and a facing side of the second arm are adjacent, and an open position, in which the facing side of the first arm and the facing side of the second arm are spaced apart, a power pack disposed between the first arm and the second arm and coupled to the hair styling apparatus at the hinge end, and a wire harness for coupling the power pack to a heater arrangement, wherein the wire harness has a first portion extending within the power pack and a second portion extending within the first or second arm.

The term "harness" refers to an arrangement of wires once they are assembled within a product.

Preferably, the wire harness has a point of inflection between the first portion and the second portion, and the point of inflection is in proximity to the hinge. It is preferred that the first portion of the wire harness is coupled to the power pack. Preferably, the second portion of the wire harness is coupled to the heater arrangement.

In a preferred embodiment, the first and second portions of the wire harness are disposed parallel to one another when the first and second arms are in a closed position. Further, the first and second portions of the wire harness may be disposed at an angle to one another when the first and second arms are in an open position. Preferably, the power pack is adapted to receive the first portion of the wire harness, and an inner surface of at least one of the first and second arms is adapted to receive the second portion the wire harness.

In a preferred embodiment, the heater arrangement is disposed within at least one of the first and second arms. Each of the first and second arms may comprise one wire harness or each of the first and second arms may comprise two wire harnesses. Preferably, each of the first and second arms carry the second portion of a wire harness carrying a positive charge and the second portion of a wire harness carrying a negative charge.

The four power harnesses are routed indirectly between the power source and the heater assembly. This indirect routing is achieved via articulating each harness at the hinge end of the hair styling apparatus. Advantageously, this articulation of the harnesses minimises wire fatigue and avoids any disconnect in the power route between the power source and the heaters.

A fifth aspect of the present invention provides a hair styling apparatus comprising a first arm and a second arm coupled together at a hinge end thereof to allow the first arm and the second arm to be moveable between a closed position, in which a facing side of the first arm and a facing side of the second arm are adjacent, and an open position, in which the facing side of the first arm and the facing side of the second arm are spaced apart, a central pack disposed between the first arm and the second arm and coupled to the hair styling apparatus at the hinge end, and a locking means disposed within the central pack; wherein the locking means comprises an elongate lock arm disposed lengthwise within the central pack.

Preferably, the locking means further comprises a lock bar disposed symmetrically at a first end of the lock arm. Preferably, the lock arm together with the lock bar has a T-shape form. It is preferred that the locking means is adapted to move relative to the central pack and between a first position and a second position; and wherein a user interface lock button on an external surface of the central pack is connected to the locking means and is adapted to move the locking means between the first position and the second position.

Preferably, the locking means further comprises an actuator movably attached to the central pack, wherein the actuator is connected to a biasing means and the actuator is biased in an extended position.

The actuator may be adapted to be moved into a contracted position when at least one of the first arm and the second arm is in a closed position. Preferably, the actuator is pushed into the contracted position by a protrusion from at least one of the first arm and the second arm. It is preferred that the locking means is movable between the first position and the second position when the actuator is in the contracted position, and that the locking means is immovable when the actuator is in the extended position.

Preferably, the biasing means is a spring, and more preferably, a coil spring.

A catch feature is integral to an inner surface of each of the first arm and the second arm. The catch features are formed to engage with the lock bar. Therefore, when the lock bar can be moved into the lock position, then the first and second arms are simultaneously and symmetrically locked to the central pack.

In a preferred embodiment, the central pack is a power pack. The central pack may comprise at least one frame and said frame is adapted to support the locking means and at least one cell and a user interface PCB. It is preferred that the lock arm is connected to the frame by a torsion spring.

BRIEF DESCRIPTION OF THE DRAWINGS

In order that the present invention may be more readily understood, an embodiment of the invention will now be described, by way of example, and with reference to the accompanying drawings, in which.

DETAILED DESCRIPTION OF THE DISCLOSURE

Figure 1:
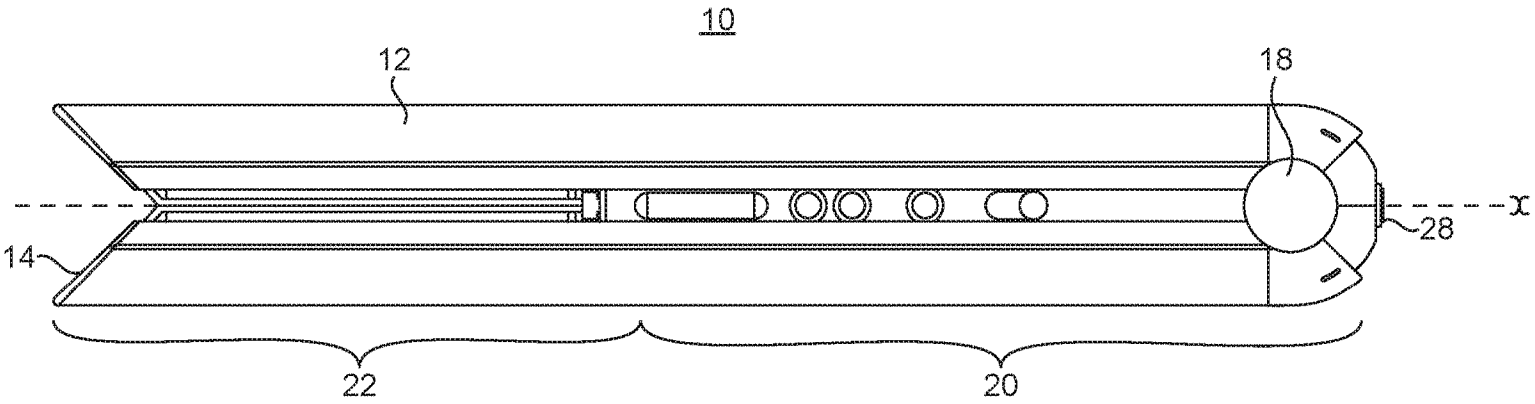
FIG. 1 is a side view of a hair styling apparatus according to the present invention.
Figure 2:
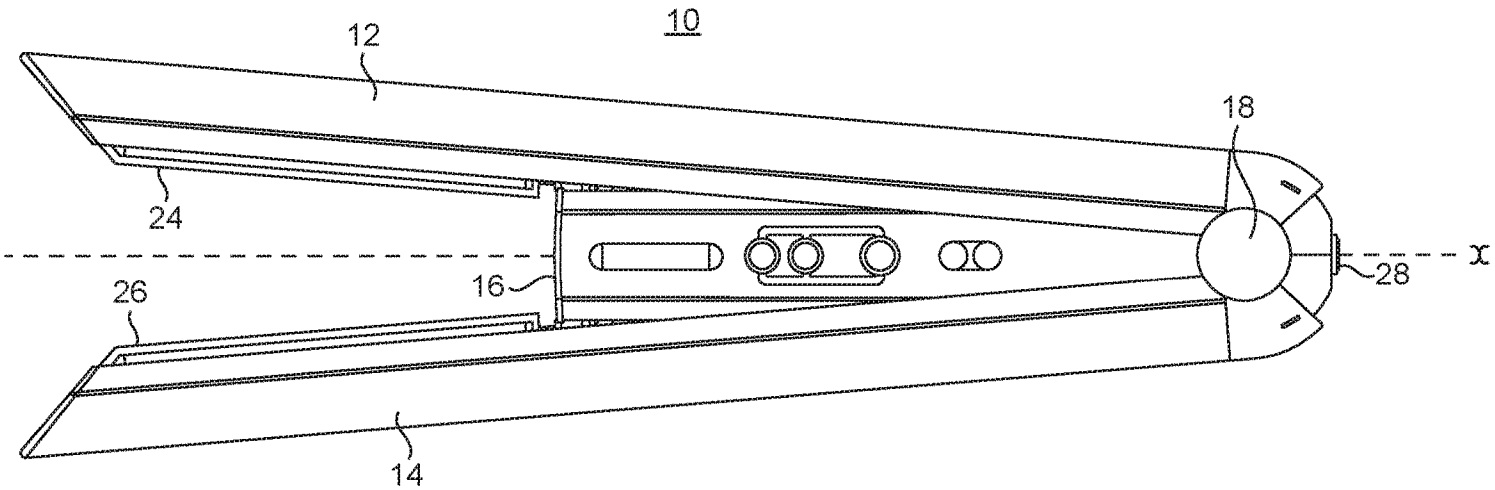
FIG. 2 is a side view of the hair styling apparatus shown in FIG. 1 with the arms in an open position.

A hair styling apparatus 10, as shown in FIGS. 1 and 2, comprises a first arm 12, a second arm 14 and a central pack 16, which are pivotally joined together at one end by a hinge 18. The hair styling apparatus 10 comprises a handle section 20 towards the hinge end of the arms and a hair contacting section 22 towards the distal end of the arms. The hair contacting section 22 comprises a plate 24, 26 arranged on at least one of the facing surfaces of the arms. The plate 24, 26 can be a flexible or non-flexible hair contacting plate, which may have an increased temperature when the hair straightening apparatus 10 is in use. When the hair straightening apparatus 10 is not in use, the plate will generally be at the ambient temperature.

A longitudinal axis, x, is indicated in FIGS. 1 and 2, which extends lengthways through the centre of the hair styling apparatus 10.

In a preferred embodiment, the hair styling apparatus 10 is a battery operated hair straightener, wherein the hair contacting section 22 comprises a heated metal plate. In such an embodiment, an electrical connector 28 is located at the hinge end of the hair styling apparatus 10, and the central pack 16 is a battery pack assembly.

Figure 3:
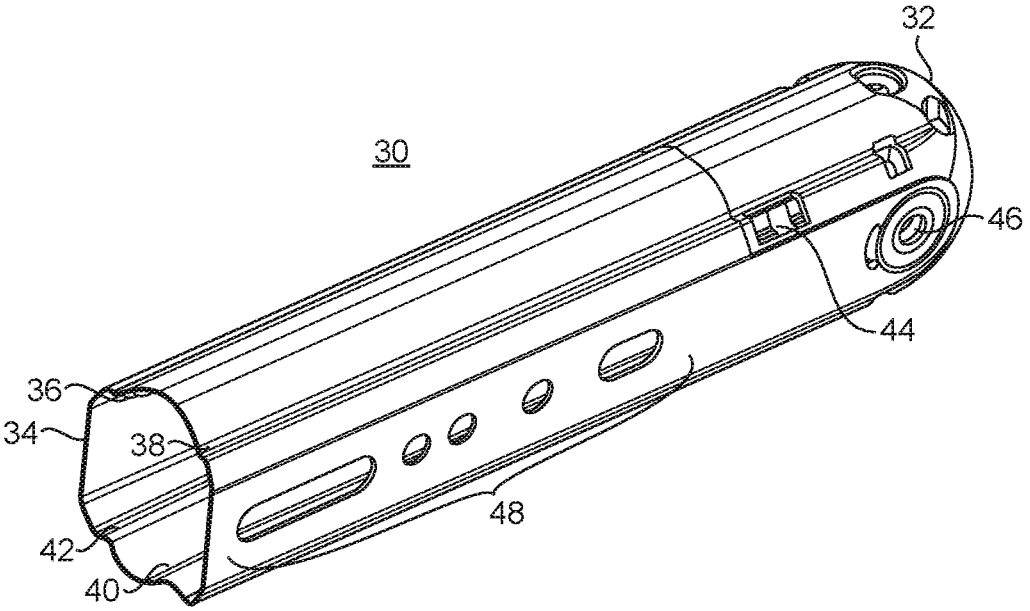
FIG. 3 is a perspective view of a battery pack sleeve of the hair styling apparatus.

With reference to FIG. 3, a battery pack sleeve 30 is generally tubular and provides a protective casing for a battery pack. The battery pack sleeve 30 has a first end 32 which is substantially closed and located in proximity to the hinge, and a second end 34 which is open and located in proximity to the heated plates. The battery pack sleeve 30 has a first harness guide 36 formed in the battery pack sleeve 30 and extending between the first end 32 and the second end 34. A second harness guide 38 also extends along the battery pack sleeve 30, parallel to the first harness guide 36. The battery pack sleeve 30 has a third harness guide 40 and a fourth harness guide 42 extending along an inner face of the battery pack sleeve 30 between the first end 32 and the second end 34, and parallel to the third harness guide.

An aperture 44 is located on the second harness guide 38 towards the first end 32 of the battery pack sleeve 30. Similar apertures are positioned on each harness guide towards the first end of the battery pack sleeve but cannot be seen in FIG. 3. A hinge screw hole 46 is formed on each of opposing sides of the first end of the battery pack sleeve 30. Several rounded cutouts 48 are located in a face of the battery pack sleeve 30 between the second and third harness guides.

Figure 4:
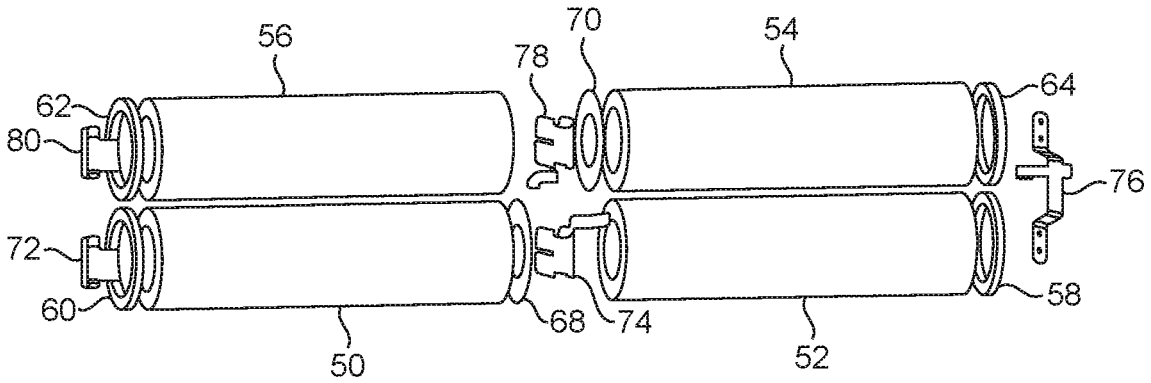
FIG. 4 is an exploded view of an arrangement of cells and connectors.

An arrangement of four rechargeable cylindrical battery cells are shown in FIG. 4. An end face of a first cell 50 is aligned with an end face of a second cell 52, and electrically joined in series. An end face of a third cell 54 is aligned with an end face of a fourth cell 56, and electrically joined in series. The first and second cells 50, 52 are joined in parallel with the third and fourth cells 54, 56. A foam ring 58, 60, 62, 64 having an outer diameter similar to each cell is positioned at an outer end face of each cell 50, 52, 54, 56. Such foam rings function to absorb a shock to the battery pack 16 when the hair styling apparatus 10 is in use. A fish paper ring 68 having an outer diameter similar to each cell is positioned between an end face of the first cell 50 and the second cell 52 and a further fish paper ring 70 is positioned between the third cell 54 and the fourth cell 56.

Each cell is a high power lithium-ion cell of around 3.8V and has a relatively high capacity of around 1400 mAh. Each cell has a maximum charge of approximately 6.5 A and a maximum discharge of approximately 20 A.

A first cell tab 72 is connected to a positive terminal of the first cell 50. A positive terminal of the second cell 52 is connected to a negative terminal of the first cell via a second interconnect tab 74. A negative terminal of the second cell is connected to a positive terminal of the third cell 54 via a third interconnect tab 76. A positive terminal of the fourth cell 56 is connected to a negative terminal of the third cell 54 via a fourth interconnect tab 78. A fifth cell tab 80 is connected to a negative terminal of the fourth cell 56.

Each connection in the illustrated embodiment is a welded connection realised by resistance welding. Alternatively, the connection between the battery pack tabs and the battery terminals may be realised by any suitable form of weld or join or solder.

Figure 5A:
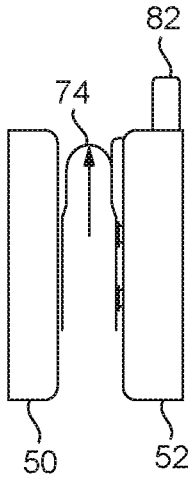
FIG. 5*a* is a side view of a connection between two of the cells shown in FIG. 4.

FIG. 5*a* illustrates the connection between the first cell 50 and the second cell 52, and also between the third cell 54 and the fourth cell 56. The interconnect tab 74, 78 forms a U-shaped bend between the connected cells. Advantageously, this shape provides some elastic movement between the cells, as well as minimising space requirements for four connected cells. The interconnect tab 74 further comprises a protrusion 82 which, in the assembled apparatus, is disposed through a second frame part (illustrated in FIG. 6) and soldered to a battery management system PCB.

Figure 5B:
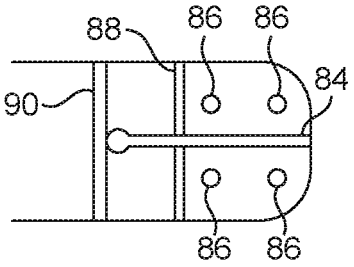
FIG. 5*b* illustrates a first tab layout.

In FIG. 5*b*, a first tab layout is illustrated having a straight slot 84 with two welding dimples 86 on either side of the straight slot 84. A first yield line 88 extends from a first edge of the tab to a second, opposite, edge of the tab, and traverses the straight slot 84. A second yield line 90 extends from the first edge of the tab to the second, opposite, edge of the tab, adjacent the end of the straight slot 84. (As shown in FIG. 4, a yield line may allow a flection of the tab in either fold direction.)

Figure 5C:
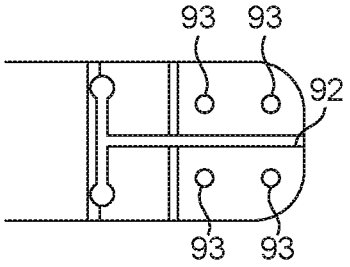
FIG. 5*c* illustrates a second tab layout.
Figure 5D:
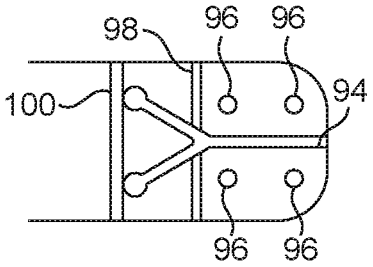
FIG. 5*d* illustrates a third tab layout.

In order to optimise the weld current, a longer slot length is required. However, whilst the second tab layout shown in FIG. 5*c*, increases slot length by having a T-shaped slot 92 with two welding dimples 93 on either side of the slot. Such a T-shape introduces a potential structural weakness where the slot coincides with a yield line. Therefore, in FIG. 5*d*, a third tab layout is illustrated having a Y-shaped slot 94 with two welding dimples 96 on either side of the slot. A first yield line 98 extends from a first edge of the tab to a second, opposite, edge of the tab, and traverses a mid-point of the Y-shaped slot 94. A second yield line 100 extends from the first edge of the tab to the second, opposite, edge of the tab, adjacent the ends of the Y-shaped slot 94.

Advantage is obtained from a Y-shaped slot, as a consequence of the greater total slot length in comparison with the straight slot of FIG. 5*b*. Specifically, a greater total slot length optimises the weld current during the resistive welding process, thereby increasing the weld temperature at the base of each dimple.

The battery pack tabs are preferably comprised of a copper alloy having a thickness of approximately 0.2 mm. The battery pack tabs may have a tin plating of approximately 3 microns thickness.

Figure 6:
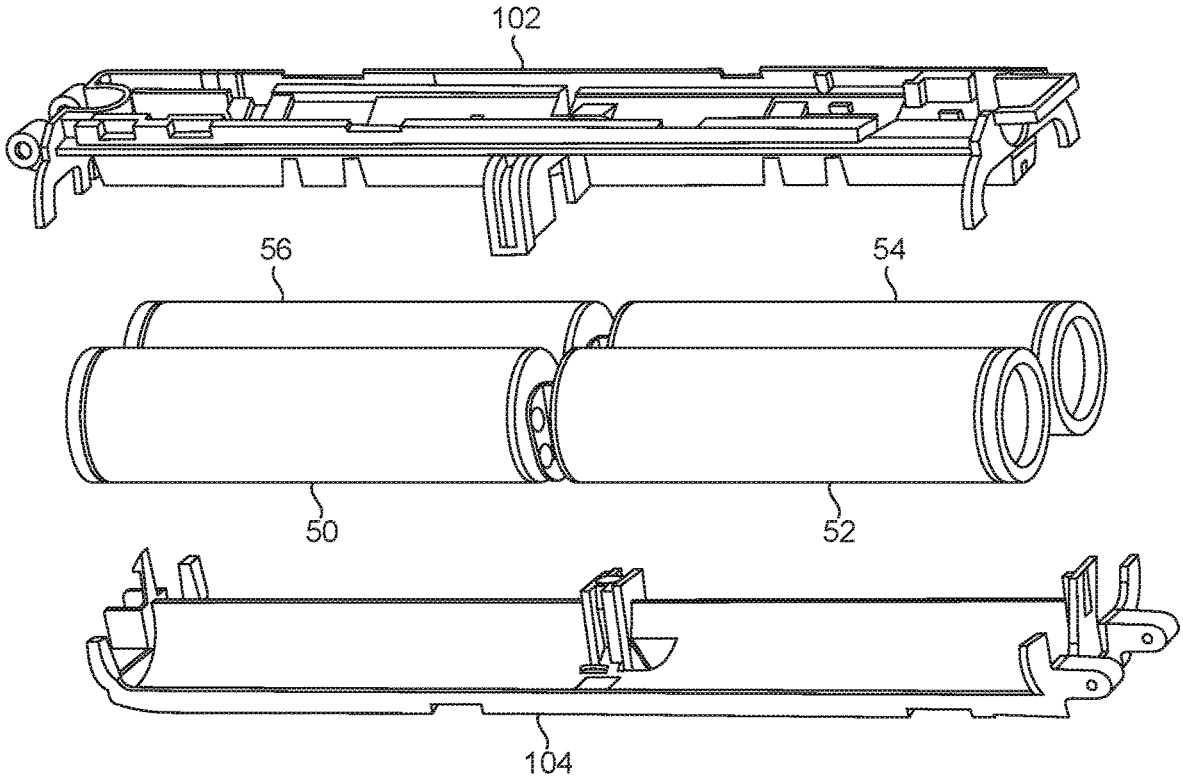
FIG. 6 is an exploded view of a battery pack.

The arrangement of four cells is secured within a frame comprising a first frame part 102 and a second frame part 104, as shown in FIG. 6. An inner face of each of the first frame part 102 and the second frame part 104 fits and engages the arrangement of four cells 52, 54, 56, 58. An outer face of the first frame part 102 is arranged to support a user interface PCB and an outer face of the second frame part 104 is arranged to support a battery management system PCB. The first and second frame parts also provide stability for the combined arrangement of the cells and PCBs. Also, the first and second frame parts house the cells and PCBs in close proximity, thereby minimising the combined volume of these parts and consequently the overall circumference of the hair styling apparatus. Further, an OLED and a speaker (not shown) are mounted on the user interface PCB, and the assembled hair styling apparatus 10 is arranged such a sound chamber cavity is formed adjacent to the speaker. The first frame part 102 and the second frame part 104 comprise snap-fit structures as an engagement mechanism to fix them together.

In such a hair styling apparatus 10, there is a need to route the power from the central battery pack 16 to the heater assembly in each arm. However, when the arms are in an open position, there is gap between the battery pack and the arms at the distal end of the battery pack. An electrical join across this gap would potentially be a high resistance connection which could cause heat to develop. Therefore, an alternative scheme for transferring power from the battery pack to the at least one heater assembly is desirable.

Figure 7:
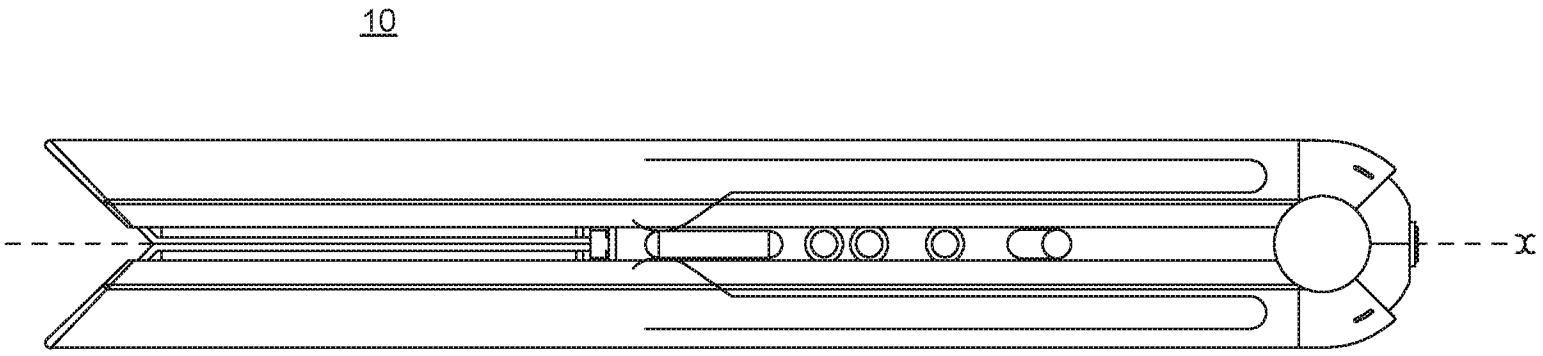
FIG. 7 is a schematic illustration of two power harnesses in relation to the arms of the hair styling apparatus.

In FIG. 7, a route of two power harnesses is schematically illustrated in relation to the arms of the hair styling apparatus. The route of each power harness runs generally parallel to the longitudinal axis, x, both on a path towards the hinge end and also, after an articulation, on a return path towards a distal end. The path towards the hinge is routed along an inner surface of the battery pack sleeve 30 and the return path towards the distal end of the apparatus is routed through the first or second arm 12, 14, respectively.

A first end of each power harness is connected to the battery management system PCB.

This connection may be realised by a soldered join. A second end of each power harness is connected to a heater assembly located within each arm of the hair styling apparatus. This connection may be a wire to wire interconnect, realised by a crimp terminal.

Each power harness is preferably a 20 AWG wire having PTFE insulation. PTFE insulation is highly effective and consequently a relatively thin layer of PTFE around the central wire strands is required. This allows each power harness to have a minimised diameter and is therefore advantageous in minimising the volume occupied by the four power harnesses in the hair styling apparatus.

Figure 8:
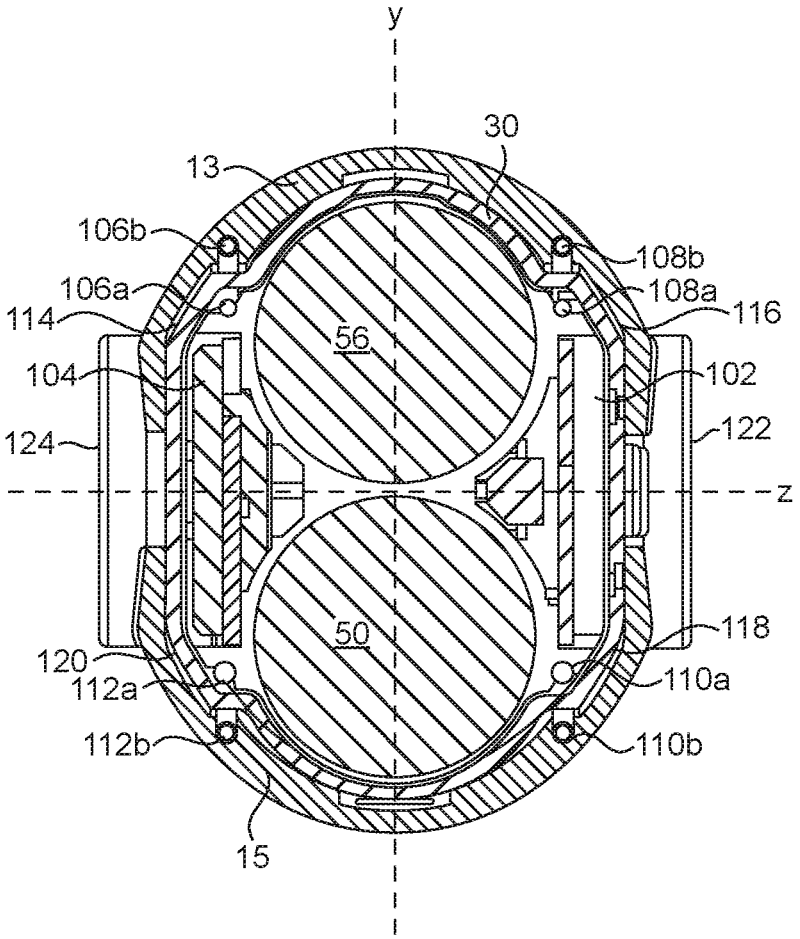
FIG. 8 is a sectional view through a handle section of the hair styling apparatus.

The cross-sectional view through the handle section, shown in FIG. 8, shows four power harnesses, each running towards the hinge end (denoted as a) and returning towards the distal end (denoted as b). In use, a first harness 106 carries a negative current, a second harness 108 carries a positive current, a third harness 110 carries a negative current, and a fourth harness 112 carries a positive current. It should be noted that the first end of both the second and third harnesses are routed across the battery pack to the battery management system PCB via an over harness chassis (not shown) which is integral to the battery pack 16.

The first cell 50 is located adjacent to the forth cell 56, and the first and forth cell are positioned centrally along a y-axis of the apparatus. The battery pack sleeve 30 surrounds both cells 50, 56 with a small tolerance gap between the sleeve and the cells to allow for manufacturing tolerances and possible thermal expansion of the components. An interference rib 114, 116, 118, 120 is located between the external surface of the battery pack sleeve 30 and an inner surface of one of the arm shells 13, 15, adjacent to each power harness. The interference ribs 114, 116, 118, 120 immobilise the battery pack within the battery sleeve.

FIG. 8 illustrates the symmetry of the handle section of the hair styling apparatus with respect to the y-axis and the z-axis. A first hinge screw 122 and a second hinge screw 124 are positioned symmetrically at each side of the hinge end of the hair styling apparatus. The first frame part 102 and the second frame part 104 are also symmetrically arranged with respect to the y-axis and the z-axis.

Figure 9:
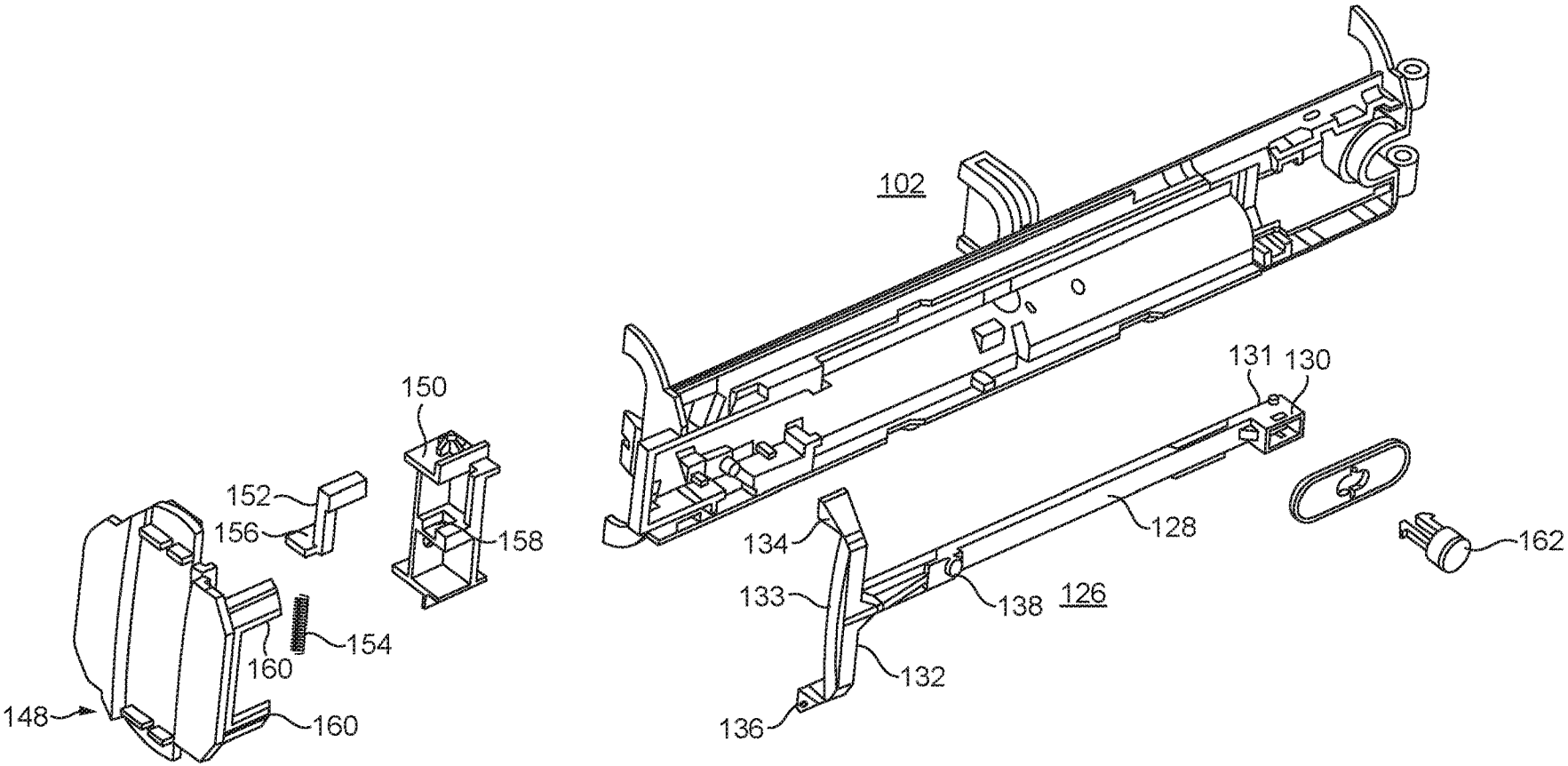
FIG. 9 is an exploded view of a lock mechanism of the hair styling apparatus.

FIGS. 9 to 11 illustrate the form and function of a locking mechanism which enables the arms of the styling apparatus to be fixed in a closed position by a user-actuated sliding button. Whilst the illustrated embodiment comprises a central pack which is a battery pack, the central pack may alternatively be a motor pack providing airflow or vibrational movement to the styling apparatus arms, or a power pack providing any electromagnetic radiation to the styling apparatus arms.

A lock arm 126 extends longitudinally within the handle section 20 of the hair styling apparatus 10 and is located between the arm shells 13, 15 and the first frame part 102. The lock arm 126 has a T-shape form and comprises a shaft 128 with a slider cap receiver 130 at a first end 131, and a perpendicular lock bar 132 at the second end 133. The lock bar 132 has a lock bar block 134, 136 at each end, which, in the embodiment illustrated, is a triangular prism. The lock arm 126 is positioned with the first end 131 in proximity to the hinge 18 end of the styling apparatus.

The lock arm 126 further comprises a lock arm boss 138 protruding from the lock arm 126 on the side adjacent the first and second arm shells 13, 15. The lock arm boss 138 passes through a first leg 140 of a torsion spring 142 and a first frame boss 144 passes through a second leg 146 of the torsion spring 142 (shown in FIG. 11*a*). The torsion spring 142 functions as a biasing mechanism move the lock arm towards the hinge 18 end of the styling apparatus 10.

Figures 10A, 10B:
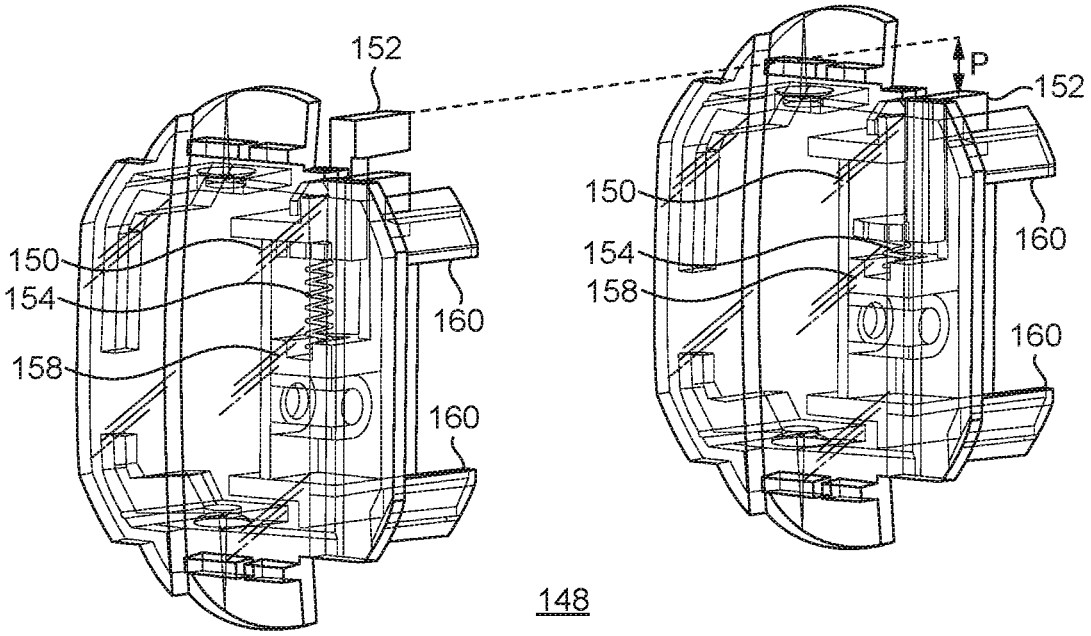
FIGS. 10*a* and 10*b* show a front perspective view of a battery pack sleeve cap arrangement in a first position and a second position, respectively.

A sleeve cap 148 of a battery pack sleeve 30, a spring housing 150, a lock out actuator 152 and a lock out spring 154 are seen separately in FIG. 9, and in assembled position in a transparent illustration of the sleeve cap 148 in FIGS. 10*a* and 10*b*. A first end of the spring 154 is attached to a foot 156 of the lock out actuator 152 and a second end of the spring 154 is attached to a stabilising base 158 at a mid-point within the spring housing 150. In both an extended state and a compressed state of the spring 154, the actuator foot 156 is positioned within the spring housing 150. The spring housing is fixed to the sleeve cap 148 and the sleeve cap comprises longitudinal engaging protrusions 160 which have a friction fit within the battery pack sleeve 30, thereby fixing the position of the spring housing 150 relative to the first and second frame parts 102, 104.

Figure 11A:
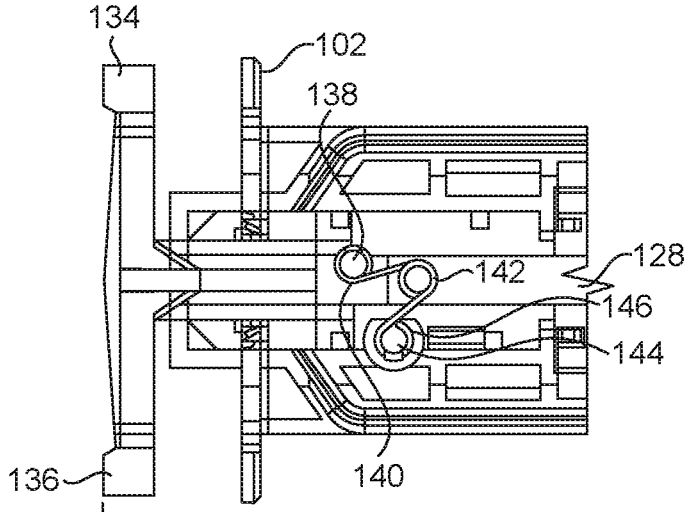
FIGS. 11*a* and 11*b* show a side view of the lock arm mechanism in a first position and a second position, respectively.

In use, when the styling apparatus arms 12, 14 are arranged in an open position, then the lock out spring 154 is in the extended state within the spring housing 150. Consequently, the lock out actuator 152 is in an extended position, as seen in FIG. 10*a*. In this position, the lock out actuator 152 abuts the lock bar block 134, as shown in FIG. 11*a*, thereby fixing the lock arm 126 in position and rendering the lock button 162 immovable.

Figure 11B:
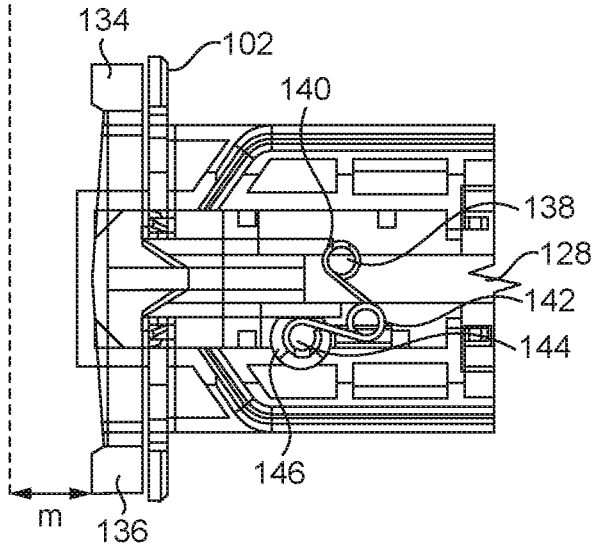

When the styling apparatus arms 12, 14 are moved from the open position towards the closed position, a protrusion (not shown) on an inner surface of the first arm comes into contact with the lock out actuator and then gradually pushes the lock out actuator 152 a distance p towards the second arm. When the styling apparatus arms 12, 14 are in a fully closed position, then the lock out spring 154 is in the compressed state within the spring housing 150 and the lock out actuator is in a retracted position, as seen in FIG. 10*b*. In this lock position, the lock out actuator 152 no longer abuts the lock bar block 134 thereby allowing the lock arm 126 to move distance m, towards the hinge 18 end of the styling apparatus 10 when the user actuates the lock button 162, as shown in FIG. 11*b*.

A catch feature (not shown) is integral to an inner surface of each of the first arm shell 13 and the second arm shell 15. The catch features are formed to engage with the lock bar 132. Therefore, when the lock arm 126 can be moved into the lock position, then the first and second arms 12, 14 are simultaneously and symmetrically locked to the central pack 16.

Figure 12:
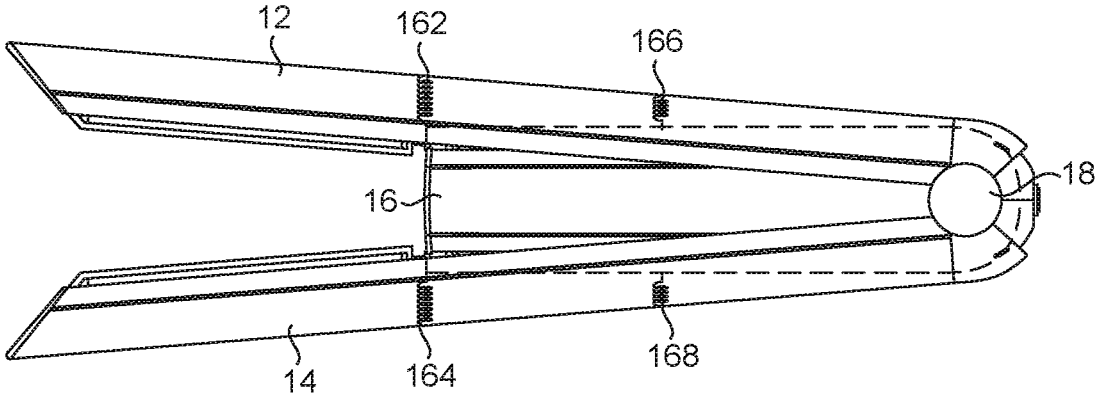
FIG. 12 shows a first configuration of a spring mechanism between the arms.

The general structure of the hair styling apparatus, as shown schematically in FIG. 12, comprises a first arm 12, a second arm 14 and a central pack 16. Where the first and second arms are substantially identical in form and weight, and the central pack has a generally constant weight distribution along its length, then the centre of mass will be located within the handle section. This increases ergonomic comfort for the user, because a balanced apparatus may minimise a user's hand and arm strain, and also be perceived as a lighter in weight in comparison to an unbalanced apparatus. Importantly, the present hair styling apparatus has a spring mechanism for elastically opening and closing the arms, which maintains symmetry of the styling apparatus about the x-axis during the opening action and also when the arms are fully open. This provides significant ergonomic benefit for the user, as the styling apparatus feels balanced in use.

Figure 13:
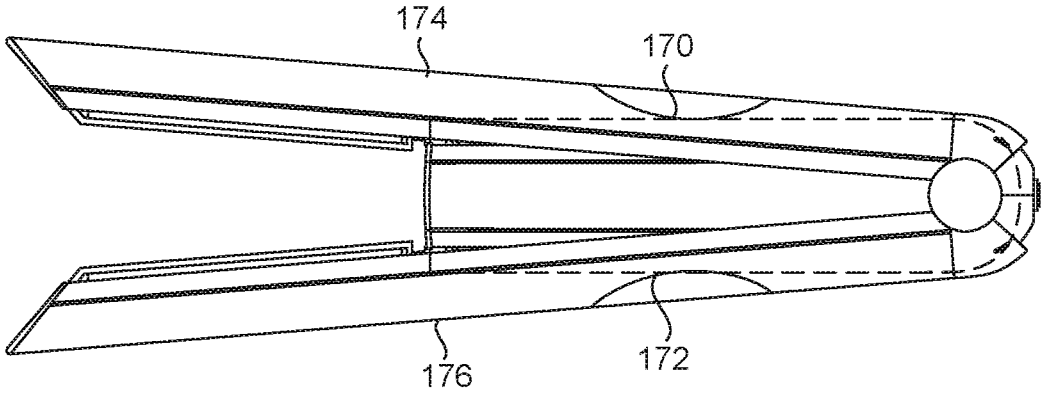
FIG. 13 shows an alternative configuration of the spring mechanism between the arms.

FIGS. 12, 13 and 14 schematically illustrate options for elastically securing the arms and central pack to one another, enabling the arms to be biased into the open position and also smoothly closeable by the user.

FIG. 12 illustrates a first coil spring 162 attached between an internal surface of the first arm 12 and an adjacent surface of the central pack 16 and a second coil spring 164 attached between an internal surface of the second arm 14 and the central pack 16. This symmetrical arrangement is mechanically simple and reliable whilst maintaining a balanced weight distribution within the styling apparatus. Alternatively or additionally, a third and fourth coil spring 166, 168 can be positioned in closer proximity to the hinge 18 end of the styling apparatus 10. Such an alternative arrangement of the coil springs is also shown in FIG. 12.

FIG. 13 schematically illustrates a first leaf spring 170 positioned between an internal surface of the first arm 12 and an adjacent surface of the central pack 16 and a second leaf spring 172 positioned between an internal surface of the second arm 14 and the central pack 16. The first and second leaf springs 170, 172 are formed out of metal and may be flat or cylindrical in cross-section and each of the first and second leaf springs may be composed of one or more leaf springs. Again, this symmetrical arrangement is mechanically simple and reliable whilst maintaining a balanced weight distribution within the styling apparatus. In a preferred embodiment, the first and second arms comprise a metal arm structure 174, 176 and the leaf springs 170, 172 are integrally formed with the metal arm structure. Such a metal arm structure is beneficial with respect to the rigidity of the apparatus and an outermost surface of the metal arm structure is covered by a plastics layer.

Figure 14A:
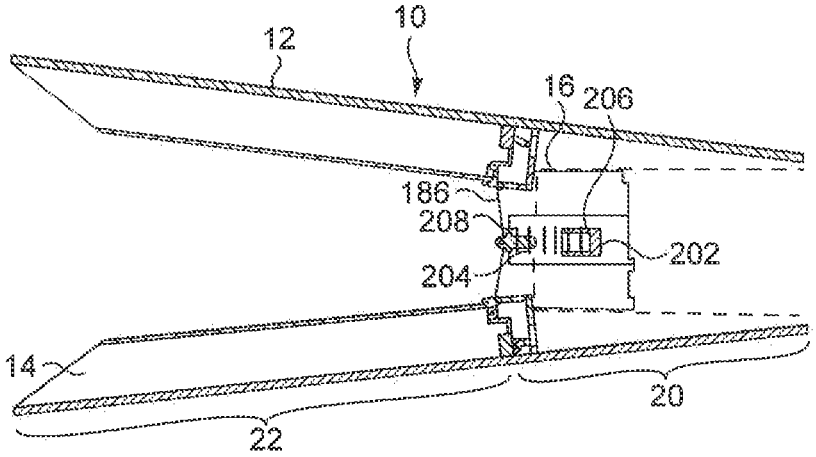
FIGS. 14*a* to 14*e* show a yet further configuration of the spring mechanism between the arms.
Figure 14B:
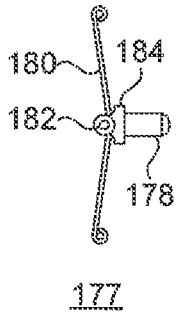
Figure 14C:
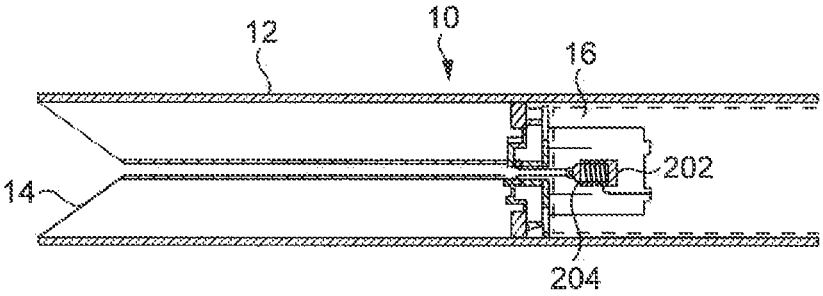
Figure 14D:
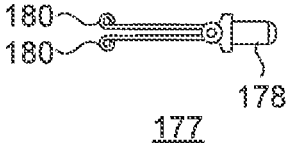
Figure 14F:
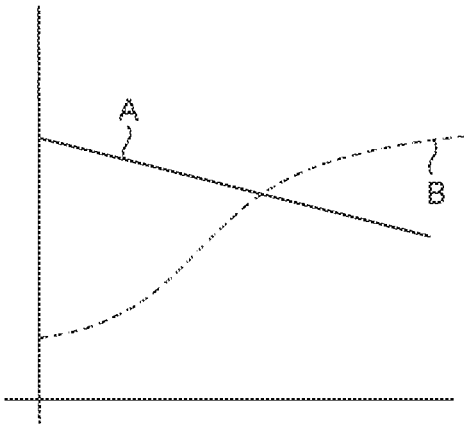
FIG. 14*f* is a graph showing the spring force of the spring mechanism illustrated in FIGS. 14*a* to 14*e*, and of a prior art coil spring.
Figure 14E:
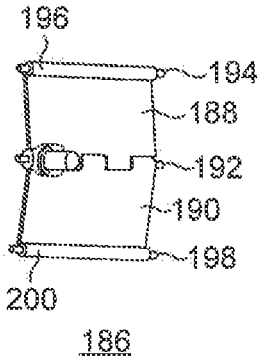

A further spring arrangement is illustrated schematically in FIGS. 14*a* to 14*e*, and may be utilised alone or in combination with the spring arrangement described with respect to FIG. 12 or FIG. 13. As illustrated in FIG. 14*b*, a torsion spring arrangement 177 comprises a lug 178 attached to a torsion spring 180 at the central pivot point 182 of the torsion spring. The lug 178 comprises a shoulder 184 having a greater diameter than the main cylindrical portion of the lug 178. A folding cover 186 is illustrated in FIG. 14*e*, and comprises a first board portion 188 and a second board portion 190, together with the torsion spring arrangement 177. The first and second board portions 188, 190 share a common hinged edge held together and pivoted by a central pin 192. A first pin 194 passes through a tubular passage 196 at an outer edge of the first board portion 188, and a second pin 198 passes through a tubular passage 200 at an outer edge of the second board portion 190. The torsion spring arrangement 177 is attached to the folding cover 186 by fixing the pivot point 182 of the torsion spring arrangement 177 over the central pin 192, and fixing the first and second legs of the torsion spring arrangement 177 over the first and second pins 194, 198, respectively.

With reference to FIG. 14*a*, the folding cover 186 is located in between the first and second arms 12, 14 of the hair styling apparatus 10, and at the transition between the hair contacting section 22 and the handle section 20. Both ends of the first pin 194 are received into receiving apertures on the first arm 12, and both ends of the second pin 198 are received into receiving apertures on the second arm 14. The central pack 16 comprises a receptacle 202 positioned to receive the lug 178 of the torsion spring arrangement when the first and second arms 12, 14 of the styling apparatus are closed, as illustrated in FIG. 14*c*. When the first and second arms of the styling apparatus are moved to an open position, the lug 178 of the torsion spring arrangement 177 is lifted out of the receptacle 202 by the movement of the folding cover 186 and connected torsion spring 180.

A coil spring 204 is located between the receptacle 202 and the lug, in order to moderate the relative movement of the lug 178 with respect to the receptacle 202. The coil spring 204 may be connected to the lug 178, or within the receptacle 202, or both. A first end 206 of the coil spring abuts a base of the receptacle and a second end 208 of the coil spring 204 abuts the shoulder 184 of the lug 178. Advantageously, this arrangement of the torsion spring 177 and the coil spring 204 provides a progressively lower spring force as the arms of the styling apparatus are moved into the closed position (minimal angular displacement), whilst providing a progressively greater spring force as the styling apparatus arms are moved into the open position (maximal angular displacement), as shown schematically by data line B in FIG. 14*f*. Thus, although the styling apparatus arms are biased into the open position, the user can easily squeeze the arms into the closed position in order to grip the tress of hair.

For comparison, data line A in FIG. 14*f* schematically shows the spring characteristic of a typical spring mechanism for which the spring force increases as the arms are moved from the open to the closed position. Therefore, greatest effort is required by a user to squeeze the styling apparatus arms together in order to grip the hair between the arms. Repetition of this action could result in discomfort for the user.

Advantageously, the folding cover 186 protects the central pack 16 from ingress of debris, such as single hairs or chemical hair products. The folding cover additionally functions to maintain the parallel arrangement and smooth functioning of the styling apparatus arms, by impeding accidental torsional movement of between the styling apparatus arms. In a further embodiment, a second torsion spring arrangement could be included at the other edge of the folding cover in order to increase the symmetry and balance of the hair styling apparatus, but mainly to further avoid the possibility of accidental torsional movement between the arms of the styling apparatus. In an alternative embodiment, the folding cover may comprise a flexible material without a central hinged section.

Each of the spring arrangements described in relation to FIGS. 12, 13 and 14 may be used alone or in combination with springs at the hinge end of the styling apparatus. The springs at the hinge of the styling apparatus may be torsion springs or C-cup springs, and the hinge arrangement may be exposed on an external face of the styling apparatus or concealed under the arm structure.

It will be apparent to the skilled person that various alternatives are possible within the scope of the present invention. For example, any number of symmetrically arranged rechargeable cells may be utilised, including a single cell arrangement. The cells may be connected in various electrical arrangements; either in series or in parallel or a combination of both. The battery pack sleeve may comprise an opening at either the hinge end or the distal end, through which the arrangement of cell(s) may be inserted, and a battery sleeve cap is subsequently attached over the opening.

The hair contacting section may comprise a heated plate arranged on at least one of the facing surfaces of the arms. The heated plate may be a regular, non-flexing heated plate or, alternatively, the heated plate may be flexible. In use, the hair contacting surface 32 of the heated plate 24 may have a temperature between 50° C. and 250° C., and more preferably between 150° C. and 210° C. The hair contacting surface, may have a form which is non-rectangular in shape, such as a square, an oval or an irregular form.

With reference to the battery pack arrangement shown in FIG. 6, the first frame part and the second frame part may comprise alternative engagement mechanisms, such as interlocking parts, to fix them together. During assembly, the battery pack may be inserted into the battery pack sleeve via an opening at the hinge end or the distal end of the battery pack sleeve.

With reference to FIG. 8, the interference ribs secure the battery pack within the battery sleeve and may, alternatively, be integrally moulded as part of the battery pack sleeve or, alternatively, part of the first and second arm shell.

With reference to FIG. 9, the lock bar block at the end of the lock bar may have any suitable form. Further, the lock bar may have a lock bar block at only one end in order to allow correct functionality of the locking mechanism. However, a symmetrical lock arm may be preferable to provide a symmetrical weight distribution to ensure smooth functioning of the user interaction slider cap action. The lock arm may be comprised of plastic or metal, such as stainless steel.

A single lock out actuator which abuts one of the two lock bar blocks, has been described herein. However, a second lock out actuator (and associated lock out spring and spring housing), may be employed symmetrically about the z-axis from the lock out actuator. The second lock out actuator would abut a second of the two lock bar blocks. Advantageously, such a second lock out actuator would avoid any asymmetrical or torsional forces being applied to the lock arm.

Although the haircare apparatus described herein is generally referred to as hair styling apparatus, and in particular a hair straightener, the apparatus may function to dry or style the hair in various ways when a tress is gripped between the arms. For example, some features of the haircare apparatus described herein can be utilised with a hair styling apparatus which comprises plates providing heat alone or plates providing heat and airflow.

The invention is not limited to the detailed description given above. Variations will be apparent to the person skilled in the art.

The invention claimed is:

1. A hair styling apparatus comprising:

a first arm and a second arm pivotably coupled together at a hinge to allow the first arm and the second arm to be moveable between a closed position, in which a facing side of the first arm and a facing side of the second arm are adjacent, and an open position, in which the facing side of the first arm and the facing side of the second arm are spaced apart;

a central pack disposed between the first arm and the second arm and coupled to the hair styling apparatus proximate the hinge; and at least one biaser configured to symmetrically support the central pack between the first arm and the second arm.

2. The hair styling apparatus of claim 1, wherein the central pack comprises a power pack.

3. The hair styling apparatus of claim 2, wherein the power pack comprises at least one cell.

4. The hair styling apparatus of claim 1, wherein the central pack comprises a motor.

5. The hair styling apparatus of claim 4, wherein the central pack comprises a fan.

6. The hair styling apparatus of claim 1, further comprising:

a cover connected between the first arm and the second arm, wherein the cover is adapted to protect the central pack.

7. The hair styling apparatus of claim 1, wherein the at least one biaser comprises at least one spring.

8. The hair styling apparatus of claim 7, wherein the at least one spring comprises a first spring coupled between the first arm and the central pack, and a second spring coupled between the second arm and the central pack, wherein the first spring and the second spring are symmetrically disposed with respect to a longitudinal central axis of the hair styling apparatus.

9. The hair styling apparatus of claim 8, wherein the first spring and the second spring are coil springs.

10. The hair styling apparatus of claim 8, wherein the first spring and the second spring are leaf springs.

11. The hair styling apparatus of claim 10, wherein the first spring and the second spring are integrally formed from a metal arm casing structure.

12. The hair styling apparatus of claim 7, wherein the at least one spring comprises a torsion spring coupled to a coil spring.

13. The hair styling apparatus of claim 12, wherein the torsion spring comprises:

a pivot; and a first leg and a second leg attached to the first arm and the second arm, respectively.

14. The hair styling apparatus of claim 13, further comprising a coil spring comprising a first end attached to the pivot via a lug, and a second end attached to the central pack.

15. The hair styling apparatus of claim 13, further comprising:

a cover connected between the first arm and the second arm, wherein the cover is adapted to protect the central pack.

16. The hair styling apparatus of claim 15, wherein the cover is attached to the torsion spring, thereby enabling the cover to retract when the first arm and the second arm are in the closed position.

17. The hair styling apparatus of claim 1, wherein the first arm and the second arm are symmetrical in structure, and are substantially identical in weight.

18. The hair styling apparatus of claim 1, wherein the central pack is substantially symmetrical in structure about a longitudinal central axis of the hair styling apparatus.

19. The hair styling apparatus of claim 1, wherein:

the at least one biaser is configured to support the central pack symmetrically between the first arm and the second arm for the first and second arms being in either of the open or closed positions.

20. The hair styling apparatus of claim 1, wherein:

the at least one biaser is configured to support the central pack symmetrically between the first arm and the second arm as the first and second arms are moved between the open and closed positions.

* * * * *